US008162503B2

(12) United States Patent
Harnischmacher

(10) Patent No.: US 8,162,503 B2
(45) Date of Patent: Apr. 24, 2012

(54) PORTABLE LIGHTING DEVICE

(75) Inventor: Friedhelm Harnischmacher, Menden (DE)

(73) Assignee: Cooper Crouse-Hinds GmbH, Soest (DE)

( * ) Notice: Subject to any disclaimer, the term of this patent is extended or adjusted under 35 U.S.C. 154(b) by 442 days.

(21) Appl. No.: 11/921,938

(22) PCT Filed: Jun. 20, 2006

(86) PCT No.: PCT/EP2006/005916

§ 371 (c)(1),
(2), (4) Date: Jun. 2, 2009

(87) PCT Pub. No.: WO2006/136378

PCT Pub. Date: Dec. 28, 2006

(65) Prior Publication Data

US 2009/0268440 A1 Oct. 29, 2009

(30) Foreign Application Priority Data

Jun. 20, 2005 (DE) ..... 20 2005 009 623 U

(51) Int. Cl.
*F21V 4/00* (2006.01)

(52) U.S. Cl. ..... 362/187; 362/174

(58) Field of Classification Search ..... 362/171, 362/178, 203, 319, 449, 174, 187, 188
See application file for complete search history.

(56) References Cited

U.S. PATENT DOCUMENTS

| | | | | | |
|---|---|---|---|---|---|
| 1,478,282 | A * | 12/1923 | Hunter | 362/187 |
| 4,967,325 | A | 10/1990 | Shiau | |
| 5,021,934 | A * | 6/1991 | Hou | 362/187 |
| 5,267,131 | A * | 11/1993 | Anthony et al. | 362/208 |
| 5,475,575 | A | 12/1995 | Chin-Hsiang | |
| 5,975,714 | A * | 11/1999 | Vetorino et al. | 362/192 |
| 6,045,236 | A | 4/2000 | Cheng et al. | |
| 2004/0130892 | A1 | 7/2004 | Galli | |
| 2005/0088843 | A1 * | 4/2005 | Chapman | 362/184 |
| 2006/0256563 | A1 * | 11/2006 | Uke et al. | 362/335 |

FOREIGN PATENT DOCUMENTS

| | | | |
|---|---|---|---|
| EP | 1 241 399 | A2 | 9/2002 |
| EP | 1 548 356 | A1 | 6/2005 |
| WO | 04/001287 | A1 | 12/2003 |

* cited by examiner

*Primary Examiner* — Julie Shallenberger
(74) *Attorney, Agent, or Firm* — Fish & Richardson P.C.

(57) ABSTRACT

A portable lighting device has at least one LED light source (2). Associated with this light source are a voltage supply (3) which can be switched on and off and a light distribution device (4) for varying a luminous intensity distribution of the light source (2).

In order to improve the light distribution device in the case of such a portable lighting device in a simple way in design terms and without a considerable amount of space being required, it has a lens system (5) which can be varied in its distance in relation to the light source (2).

21 Claims, 1 Drawing Sheet

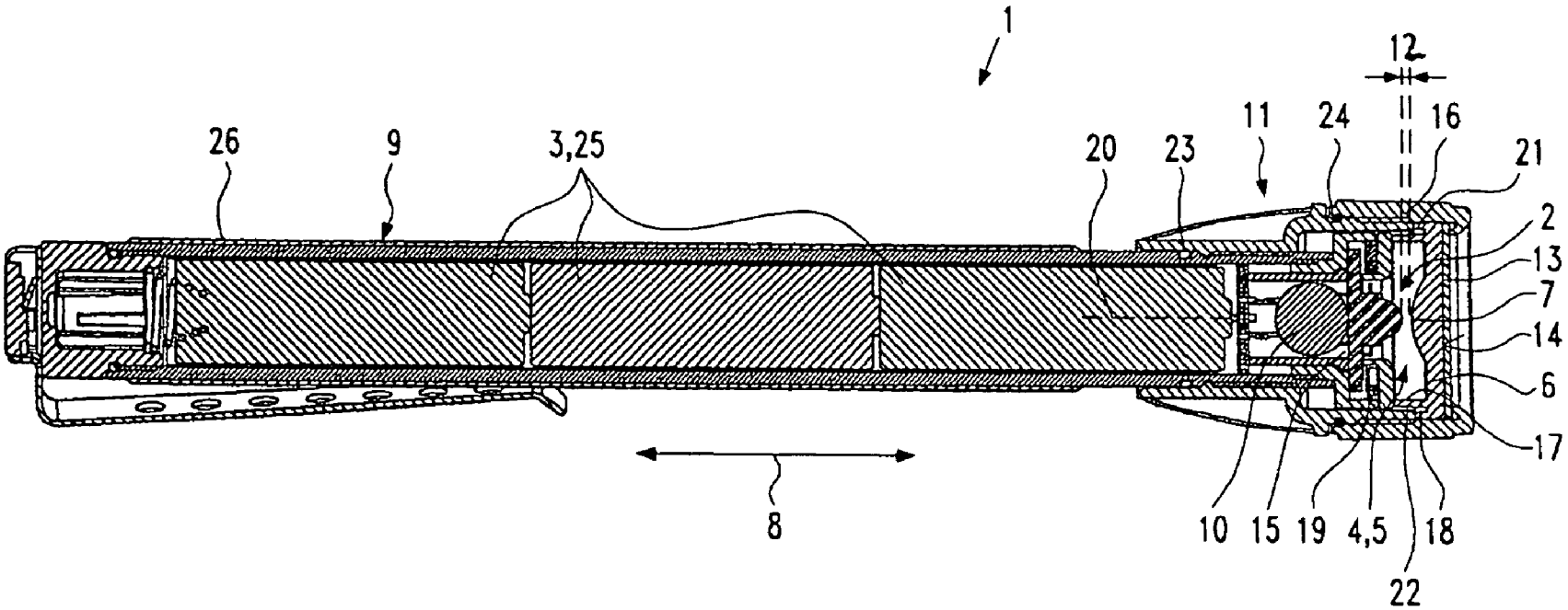
1
21
2
13
7
14
6
17
16
12
18
22
24
4,5
19
11
15
10
23
20
8
3,25
9
26

PORTABLE LIGHTING DEVICE

CROSS-REFERENCE TO RELATED APPLICATIONS

This application is the National Stage of International Application No. PCT/EP2006/005916, filed on Jun. 20, 2006, which claims priority to German Application No. 20 2005 009 623.7, filed on Jun. 20, 2005.

TECHNICAL FIELD

The present invention relates to a portable lighting device comprising at least one LED light source, a voltage supply assigned thereto and used for on- and off-switching, and a light distribution device for varying a luminous intensity distribution of the light source.

BACKGROUND

Such portable lighting devices may be configured as electric torches, flashlights, hand lamps, or also cap lamps. One or more batteries serve power supply. These batteries may be of a rechargeable type.

If a corresponding electrical contact is established between light source and voltage supply, the light source is switched on. The light source shows a specific luminous intensity distribution that can be varied by a light distribution device, if necessary.

So far LED light sources, halogen envelope lamps or also incandescent lamps have been known in practice as light sources whose luminous intensity distribution can be varied by adjusting a parabolic or hyperbolic reflector. Said reflector may be arranged at a side of the light source opposite the light exit direction.

SUMMARY

It is the object of the present invention to improve the light distribution device especially in the case of LED light sources in a simple way in design terms and without a considerable amount of space being required.

Said object is achieved by the features of claim 1.

According to the invention the light distribution device comprises a lens system which is variable in its distance in relation to the light source. Depending on the positioning of the lens system relative to the LED light source, the luminous intensity distribution of the outwardly emitted light is varied.

Troublesome constructional measures inside the lighting device are no longer needed, for instance parabolic or hyperbolic reflectors. The adjustment of such reflectors is relatively complicated in practice. Moreover, the manufacture of such reflectors for obtaining a luminous intensity distribution which is uniform in terms of rotation symmetry is rather troublesome, and deviations from such a rotation-symmetrical luminous intensity distribution are often found. The difficulties arising in the lighting devices already known from practice become even greater if more than one LED light source or if several different light sources are used.

Likewise, the technical measures for the relative adjustment of reflector and light source are troublesome; for instance when the light source is adjusted, the source should be guided not only in an accurate way relative to the reflector, but at the same time the electrical supply should be maintained all the time.

According to the invention it is only the corresponding lens system that is moved relative to the light source in such a way that the distance thereinbetween is changing. Even with a certain misalignment of light source and lens system a uniform luminous intensity distribution is achieved after all. Owing to the movement of the lens system complicated mechanisms for moving the light source can be omitted while the voltage supply is maintained.

In an advantageous embodiment, the lens system may comprise a lens disk with integrated lens. Said lens can be configured in this context as a convex lens projecting from the lens disk.

In a simple embodiment, the lens system can be supported in axial lighting device direction to be adjustable relative to the lighting device housing. In the case of a lens disk with integrated lens, it is for instance only the lens disk that must be adjusted accordingly so as to achieve a change in distance between light source and lens.

It is possible to arrange the light source fixedly in the lighting device housing and to connect the light source to the voltage supply by operating a corresponding switch or to disconnect said connection. Furthermore, it is possible to support the light source for on- and off-switching in axial lighting device direction in an adjustable manner. This means that the light source is adjusted accordingly by corresponding manipulation from the outside of the portable lighting device and is moved into its on- or off-switched position.

To arrange the light source relative to the lens system in the switched-on state in a position predetermined relative to the lighting device housing, the light source can be fixed in its axial position after having been switched on. Such a fixation can be accomplished in a simple way in that the light source in the switched-on state is for example pressed against a corresponding stop which fixes the axial position.

To improve the service life of the LED light source and to avoid a corresponding heat development at the same time, a cooling device assigned to the light source may be activated in the switched-on state of said light source.

Activation can be simplified in that for instance the cooling device is only connected in its activated state to the voltage supply. This can for example be accomplished in that the connection to the voltage supply is established through the switched-on state of the light source.

For an easier handling of the lens system for varying the distance relative to the light source, the lens system may be held in a rotatable lighting device head, the distance between lens system and light source being variable by rotating the lighting device head.

To protect, if necessary, the lens system against external influences that might soil or damage the lens system, a protection disk may be arranged on the outside of the lens system oriented away from the light source, particularly in the lighting head. Such a protection disk can for example be made from quartz or the like.

To use the portable lighting device particularly in hazardous areas, the device may be made explosion-proof.

Different LED light sources can be used with the lighting device according to the invention, for instance one with a luminous intensity distribution with spotlight or wide-beam characteristic.

To prevent a situation where the light output of the LED light source is impeded by the cooling device, the cooling device may be assigned to the light source on its backside oriented away from the lens system.

To be able to carry out assembly and possibly also repair of the portable lighting device in an easy way, the lighting device head may comprise a screwed-on screwing ring. Said screwing ring may e.g. serve to fix the lens disk with lens and the protection disk relative to the remaining lighting device head.

A possibly damaged or destroyed protection disk can be easily replaced by unscrewing the screwing ring. This applies by analogy to the lens system. There is also the possibility that following the unscrewing of the screwing ring the LED light source is accessible for maintenance work or replacement.

Different mechanisms can be used for switching the lighting device on and off. In one embodiment, especially the switching off of the lighting device can be carried out independently. One possibility of such an automatic switching off can be seen in the measure that the LED light source is e.g. spring-biased towards a switched-off position.

To define an output distance between light source and lens disk before a corresponding distance variation, the lens disk may comprise at least one ring that surrounds the lens and projects in the direction of the light source. With the help of this ring the output distance is fixed.

In this context it may further be regarded as advantageous that when the projecting ring is standing with its free end on a free sleeve end of the lighting device head and when the lighting device head is then in a first rotary position, this contact of free end and free sleeve end, for instance, defines a minimal distance between light source and lens and lens disk, respectively. By twisting the lighting device head out of said rotary position, the distance between light source and lens disk and lens, respectively, is increased. It is always ensured through the contact of the free ends that a corresponding distance between light source and lens is present in conformity with the twisting of the lighting device head.

To ensure the electrical contacting of the light source in a simple way in the switched-on state, the light source may have assigned thereto a contact ring which in the event of electrical contact with the light source will switch on said source.

To obtain a luminous intensity distribution in an easy way, which is substantially uniform in terms of rotation symmetry, the light source may be arranged on the optical axis of the lens of the lens disk.

In the presence of a plurality of LED light sources these may be distributed about the optical axis accordingly and, as a rule, spaced at an equal distance from said axis.

Especially for improving the explosion proofness of the lighting device according to the invention, said device may be coated with a plastic material by injection molding, and all devices may be arranged inside the lighting device housing in a tight and compression-proof way. This is supported by the measure that surrounding sealing elements are for instance arranged between lighting device head and lighting device housing and/or screwing ring and lighting device head.

The LED light sources can also emit colored light, if necessary; LED light sources of different colors can be used that are optionally adapted to be switched on independently. There is also the possibility that the protection disk is dyed.

An advantageous embodiment of the invention will now be explained in more detail with reference to the attached figure.

DESCRIPTION OF THE DRAWINGS

FIG. 1 is a longitudinal section through an embodiment of a portable lighting device according to the invention.

DETAILED DESCRIPTION

FIG. 1 shows a portable lighting device 1 in the form of a flashlight with a plurality of batteries 25 arranged in a lighting device housing 9 as voltage supply 3. The batteries may be of a rechargeable type.

The lighting device housing 9 is coated with a plastic material and configured in a tight and compression-proof manner to be also usable in hazardous areas. The plastic coating 26 extends here over the greatest part of the lighting device housing 9 in axial lighting device direction 8.

At least one LED is arranged on a light output end of the lighting device 1 as a light source 2. Said LED is supported to be movable in axial lighting device direction 8 inside a lighting device head 11 configured as a switching cap. An electric circuit is opened or closed by a corresponding axial movement of the LED light source 2. In case the circuit is closed, the diode is cooled by means of a cooling device 10, with a metallic contact being established between cooling device 10 and switching cap.

In the switched-on state, the LED light source 2 is fixed in its axial position.

The cooling device 10 is assigned to a backside 15 of the LED light source 2 that is oriented towards the voltage supply 3. At the front side of the LED light source 2 that is opposite said backside 15, a light distribution device 4 is arranged in front thereof. Said light distribution device is configured as a lens system 5, the lens system 5 in the illustrated embodiment comprising a substantially planar lens disk 6 and a lens 7 integrated into said disk. The lens disk 6 with lens 7 is adjustable in axial lighting device direction 8 by rotating the lighting device head 11 with a screwing ring 16 fixed to said head. A distance 12 between LED light source 2 and lens 7 is increased or decreased by such an adjusting operation.

This change in distance will vary a luminous intensity distribution in the desired way, said distribution being predetermined by the LED light source 2 and adapted to exhibit both wide-beam and spotlight beam characteristics, with the lens 7 having a fixedly set focal length.

For adjusting lens disk 6 and lens 7 in axial lighting device direction 8 the lighting device head 11 is rotatable by means of a corresponding thread on the lighting device housing 9 and is thereby adjustably supported in axial lighting device direction 8.

The lens 7 is formed at the side facing the LED light source 2 as a convex lens, a planar protection disk 13 being arranged at the side of the lens disk 6 oriented away from the lens 7, i.e. on outside 14. This disk is in its dimensions identical with the lens disk 6 and is held via the screwing ring 16 on the lighting device head 11 together with the corresponding lens system 5 of the light distribution device 4.

The lens 7 defines an optical axis 20 on which the LED light source 2 is arranged. The distance 12 illustrated in FIG. 1 and existing between LED light source 2 and lens 7 is determined by the abutment of free ends of an inner ring 17 with a ring surrounding the LED light source 2. The inner ring 17 projects from the backside of the lens disk 6 comprising the lens 7 and is surrounded by an outer ring 18. Said inner ring has a smaller longitudinal extension than the outer ring 18 in the direction of LED light source 2 and is with its free end 21 in contact with a free sleeve end 22 of the lighting device head 11.

The ring which is in contact with the inner ring 17 and surrounds the LED light source 2 comprises a central opening in which the LED light source 2 is arranged and which is bordered by an annular flange. Said annular flange is surrounded by a contact ring 19 which upon contact with the LED light source 2 switches it on.

To configure the lighting device 1 also in the area of the lighting device head 11 in such a way that it is tight and compression-proof, annular sealing elements 23, 24 are arranged between lighting device head 11 and lighting device housing 9 and between screwing ring 16 and lighting device head 11.

According to the invention corresponding reflectors of parabolic or hyperbolic shape can be omitted so that the design of the lighting device is simple and it is nevertheless possible to change the luminous light distribution of the lighting device. This is done by way of a lens or lens system that is adjustable in axial lighting device direction 8. It is also possible to use several LED light sources that are e.g. equally distributed and arranged at the same distance from the optical axis 20. Moreover, it is also possible to assign a corresponding lens 7 to each of said LED light sources, and the focal lengths of the various lenses may here also be different for varying the luminous intensity distribution.

Furthermore, it is possible to use also colored LED light sources or to make the protection disk 13 colored if desired.

According to the invention the corresponding lens system or the light distribution device 4 formed by the lens system is moved in all of said embodiments in axial direction by rotating the lighting device head 11 in order to vary the luminous intensity distribution predetermined by the LED light source 2.

What is claimed is:

1. A portable lighting device comprising:

at least one LED light source;

a voltage supply that is assigned to the light source and that is adapted to be switched on and off;

a light distribution device for varying a luminous intensity distribution of the light source, wherein:

the light distribution device comprises a lens system which is variable in its distance from the light source, the lens system is configured as a lens disk with an integrated lens which comprises a convex portion oriented towards the light source, and the lens system is held in a rotatable lighting device head; and a substantially planar protection disk in the rotatable lighting device head, the protection disk arranged on an outer surface of the lens disk on a side of the lens system opposite a side facing the light source.

2. The portable lighting device of claim 1, wherein the lens system is supported to be adjustable in an axial lighting device direction in relation to a lighting device housing.

3. The portable lighting device of claim 1, wherein the light source is adjustably supported for on and off switching in an axial lighting device direction.

4. The portable lighting device of claim 3, wherein the light source is fixed in its axial position after having been switched on.

5. The portable lighting device of claim 3, wherein, in the switched-on state of the light source, a cooling device assigned to the light source is activated.

6. The portable lighting device of claim 5, wherein the cooling device is connected in the activated state to the voltage supply.

7. The portable lighting device of claim 1, wherein a distance between the lens system and the light source is variable by rotating the lighting device head.

8. The portable lighting device of claim 1, wherein the lighting device is explosion-proof.

9. The portable lighting device of claim 1, wherein the light source has a luminous intensity distribution with spotlight or wide-beam characteristic.

10. The portable lighting device of claim 5, wherein the cooling device is assigned to the light source on a side of the light source that is oriented away from the lens system.

11. The portable lighting device of claim 1, wherein the lighting head comprises a screwed-on screwing ring.

12. The portable lighting device of claim 1, wherein the lighting device is adapted to be switched off automatically.

13. The portable lighting device of claim 1, wherein the lens disk comprises at least one ring surrounding the lens and projecting in the direction of light source.

14. The portable lighting device of claim 1, wherein the light source has assigned thereto a contact ring which upon electrical contact with the light source switches the light source on.

15. The portable lighting device of claim 1, wherein the light source is arranged on an optical axis of the lens.

16. The portable lighting device of claim 13, wherein the at least one ring comprises an end that is standing on an end of a sleeve of the lighting head.

17. The portable lighting device of claim 11, wherein surrounding sealing elements are arranged between the lighting head and a lighting housing and between the screwing ring and the lighting device head.

18. The portable lighting device of claim 11, wherein surrounding sealing elements are arranged between the lighting device head and a lighting housing or between the screwing ring and the lighting device head.

19. The portable lighting device of claim 1, wherein the substantially planar protective disk is a colored protective lens.

20. The portable lighting device of claim 1, further comprising a lighting housing.

21. The portable lighting device of claim 1, wherein the lens disk comprises a substantially planar portion around the convex portion oriented toward the light source, and the lens disk holds the lens along a circumference of the lens.

* * * * *

UNITED STATES PATENT AND TRADEMARK OFFICE

CERTIFICATE OF CORRECTION

PATENT NO. : 8,162,503 B2
APPLICATION NO. : 11/921938
DATED : April 24, 2012
INVENTOR(S) : Friedhelm Harnischmacher It is certified that error appears in the above-identified patent and that said Letters Patent is hereby corrected as shown below:

On the title page, under Foreign Application Priority Data, replace "20 2005 009 623 U" with --20 2005 009 623.7--.

Signed and Sealed this
Fourth Day of September, 2012

David J. Kappos

David J. Kappos
*Director of the United States Patent and Trademark Office*